United States Patent [19]

Schmidt

[11] 4,307,586

[45] Dec. 29, 1981

[54] MACHINE AND METHOD FOR PRODUCING KNITGOODS WITH A PILE OR LOOP-PILE SURFACE

[75] Inventor: Gerhard Schmidt, Stuttgart, Fed. Rep. of Germany

[73] Assignee: Sulzer Morat GmbH, Fed. Rep. of Germany

[21] Appl. No.: 681,046

[22] Filed: Apr. 28, 1976

Related U.S. Application Data

[63] Continuation of Ser. No. 498,452, Aug. 19, 1974, abandoned.

[30] Foreign Application Priority Data

Aug. 31, 1973 [DE] Fed. Rep. of Germany ..... 2343886

[51] Int. Cl.[3] ..... D04B 9/14; D04B 15/32; D04B 15/24

[52] U.S. Cl. ..... 66/9 B; 66/54; 66/108 R

[58] Field of Search ..... 66/9 B, 50 R, 19, 54, 66/57, 91, 92, 93, 78, 136, 42

[56] References Cited

U.S. PATENT DOCUMENTS

| | | | |
|---|---|---|---|
| 1,592,506 | 7/1926 | Rolston | 66/78 X |
| 2,067,805 | 1/1937 | Towers | 66/9 R |
| 2,941,383 | 6/1960 | Mishcon et al. | 66/54 X |
| 3,076,327 | 2/1963 | Coile | 66/54 |
| 3,169,385 | 2/1965 | Haberhauer | 66/54 |
| 3,293,886 | 12/1966 | Nebel | 66/93 X |
| 3,449,928 | 6/1969 | Schmidt et al. | 66/50 R |
| 3,651,664 | 3/1972 | Collez | 66/9 B |
| 3,709,002 | 1/1973 | Brandt et al. | 66/9 B |
| 3,744,275 | 7/1973 | Harris | 66/50 R X |
| 3,848,432 | 11/1974 | Mishcon et al. | 66/54 |

FOREIGN PATENT DOCUMENTS

| | | | |
|---|---|---|---|
| 1585051 | 8/1969 | Fed. Rep. of Germany | 66/93 |
| 1965104 | 7/1970 | Fed. Rep. of Germany | 66/54 |
| 649643 | 1/1951 | United Kingdom | 66/9 R |

*Primary Examiner*—W. C. Reynolds

[57] ABSTRACT

A machine for producing a knitted fabric having a knitted ground material of a ground thread and a pile or loop-pile surface from additional pile threads or fibers, the machine having a plurality of individually selectable knitting elements and at least two knitting systems, each with a feeding position for the ground thread and the pile thread or a fiber web. A patterning mechanism is provided at each knitting system for selecting the particular knitting element which is to process the pile threads or fibers in that system and each knitting element having a knitting cam segment to produce the stitches.

11 Claims, 7 Drawing Figures

MACHINE AND METHOD FOR PRODUCING KNITGOODS WITH A PILE OR LOOP-PILE SURFACE

This is a Continuation of application Ser. No. 498,452, filed Aug. 19, 1974, now abandoned.

BACKGROUND OF THE INVENTION

The invention relates to a machine and a method for the production of knitgoods, comprising a base fabric having an additional plush or pile layer, said plush or pile layer being produced either by the knitting-in of additional plush or pile threads to produce a plush or terry or loop pile plush fabric, or by the combing-in of additional fibers from a fleece or a sliver to produce a fur on high pile fabric.

On known circular knitting machines of this type, two yarn feeders are provided at every knitting system, one of said feeders supplying the ground thread and the other the pile thread or the fibers so that at each knitting system, a new course is knitted from the ground thread and the pile thread or the fibers. A limited colored pattern can be produced in as much that the threads or fibers are of different color.

It has also been proposed to produce plush fabrics with larger colored on non-colored patterns by knitting certain regions only with the ground thread and a single color pile thread (German Gebrauchsmuster 7 231 254 published Nov. 23, 1972). A plush fabric of this type is characterised in that it is more dense and thicker at those regions having pile thread as compared with the remaining regions and that the regions including pile thread are higher in relief, because between them are plain regions, comprising only the ground thread.

Plush fabrics having multi-color patterns also can be produced with circular knitting machines by providing at every knitting system a feed for the ground thread and several feeds for the plush threads (e.g. German Pat. No. 671 333 published Jan. 17, 1944) and by controlling the knitting needles by a patterning mechanism such that at every knitting system, in addition to the ground thread only one selected plush or pile thread is picked up by every needle. However, circular knitting machines of this type have a major disadvantage in that every knitting system on the machine has to be relatively wide. For example, if a plush pattern is to be produced with up to four colors, then every system in addition to the thread feed for the ground thread must include four or more feeders for the plush threads of four different colors. The total number of knitting systems which can be provided around the circumference of the needle cylinder thus depends on the maximum number of colors, and in contrast to a conventional Jacquard circular knitting machine, the production speed cannot be increased, if a pattern of only two or even one color is to be produced, because the production speed depends on the total number of feeds for the ground threads which number is not variable.

To overcome the last-mentioned difficulty, it is possible to use a circular knitting machine which has at every system, one feed for the ground thread and two feeds for two different colored pile threads (e.g. German Pat. No. 671,333) so that patterns can be knitted with two colors in the normal manner. If patterns with more than two colors are to be knitted, e.g. four colors, this will be possible by combining two pairs of knitting systems into one group, such that the first system of each group knits on every needle the ground thread together with one of the first two possible pile threads while the second system of the group knits on every needle the ground thread with one of the two other available pile threads.

The advantage of such a knitting machine is that the production speed, when producing patterns with two different colored pile threads, is twice as fast as when knitting patterns with three or four colored pile threads and correspondingly, three times as fast as when knitting patterns with five or six colored pile threads. This advantage is of course counteracted by the disadvantage that patterns with more than two colors can be produced only by using two or three knitting systems for this purpose, and that consequently, two or three loop courses are knitted with the ground thread, because the ground thread is to be knitted at every system. The result of this is that in patterns with more than two colors, those regions of a course, to which pile threads are allocated but which can be introduced only in another knitting system, cannot include any pile threads, so that only ground threads are knitted in these regions. In the finished fabric these regions without pile threads, give the appearance of bare sections which are desirable only in exceptional cases, because of the ground thread is visible and because of the sickness of the fabric varies.

In similar manner, two types of circular knitting machines can be used to produce sliver high pile or fur fabrics. With one type, every knitting system is associated with a thread feeder for the ground thread and two cards for feeding at least two different fibers, so that two different color fibers can be fed as required to the knitting needles, for example, by using pattern wheels, prior to knitting the ground thread into a stitch (German Pat. No. 568 801, published Jan. 25, 1933 and German DAS 1 585 333, published Oct. 12, 1972). With the other type every knitting system comprises a thread feeder for the ground thread and only one card for feeding one kind of fibers, so that, depending on the pattern, the finished fabric will have a number of regions consisting only of ground thread, which will therefore be visible as bare regions (U.S. Pat. No. 2,953,002).

Similar arrangements can of course be made with flat knitting machines and other types of circular machines.

SUMMARY OF THE INVENTION

The object of the present invention is to overcome these disadvantages. On the basis of the above-described state of the art, a particular object of the invention is to design a machine which will allow the production of knitgoods with color-patterned pile or loop pile or plush surfaces without incurring limitations on knitting technology as the result of patterning. In particular, an optimum production speed should be attainable in every case and a fabric be produced which will have a uniform density of pile or loop pile surface without bare regions, regardless of the number of colors.

The invention provides a machine for producing a knitted fabric, consisting of a knitted ground material made from a ground thread and having a pile or loop-pile or plush surface made from additional pile or plush threads or fibers, the machine having a plurality of individually selectable knitting elements, moreover, at least two knitting systems, each with a feeder for the ground thread and the pile thread for the sliver, also a patterning mechanism at each knitting system for selecting the particular knitting element which is to process the pile threads or fibers in that system, and having each an adjustable knitting cam segment per knitting system to produce the stitches.

The machine includes means through which the knitting cam segments can be moved as desired into a knitting position and into a non-knit position.

The advantage offered by the machine is illustrated by the following examples. Assuming that at the circumference of a circular knitting machine, roughly the same space is required for each knitting cam, including the feeder for the ground thread, as for the feeder for the fibers, including the corresponding patterning device, it will then be possible, for example, to arrange side by side, either 4 knitting cams each with five feeds for the different colored pile fibers or 8 cams, each with 2 feeds for the pile fibers or 12 cams each with one feed for fibers. In the first case, one would obtain a fabric or uniform density, and the production would be 4 courses per revolution of the needle cylinder, regardless of the number of colors up to 5 colors in the pattern. In the second case, the fabric would also be of uniform density but 8 courses per revolution would be knitted up to 2 colors, and with patterns of 4 to 6 colors, there would be only 4 and 2 courses per revolution and in addition, the fabric would have bare regions. In the third case, the fabric would always have bare regions and moreover, in patterns with 2, 3 or 4 colors, there would be a production rate of 6, 4 or 3 courses per revolution respectively. In every case therefore, either productivity is reduced or the resultant knit goods would be unsatisfactory.

When using a machine embodying the invention, e.g. with 12 selectable knitting cam segments and with one feed per knitting cam, these disadvantages do not occur. For example, if a pattern is to be knitted with 2 colors, only every second knitting cam segment is in an active position, so that on successive feeder, different pile threads or fibers are fed, although stitches can be formed only with every second cam segment. Similarly, when producing a pattern with 3 or 4 colors, only every third or fourth cam segment is raised into working position, so that stitches are formed with only every third or fourth cam segment. Regardless of the number of colors, the final fabric will not have any bare regions, while on the other hand, machine productivity will be optimum in every case. Furthermore the machine can be equipped with all the facilities of known machines, i.e. the present machine could also be operated such that all knitting cam segments are engaged and thus 12 courses are knitted with each revolution of the needle cylinder. In this case, bare regions would exist in the fabric, although in individual cases, this can be taken into account.

BRIEF DESCRIPTION OF THE DRAWINGS

The invention will now be described in more detail by way of example with reference to the accompanying drawings, in which.

DESCRIPTION OF THE PREFERRED EMBODIMENT

Figure 1:
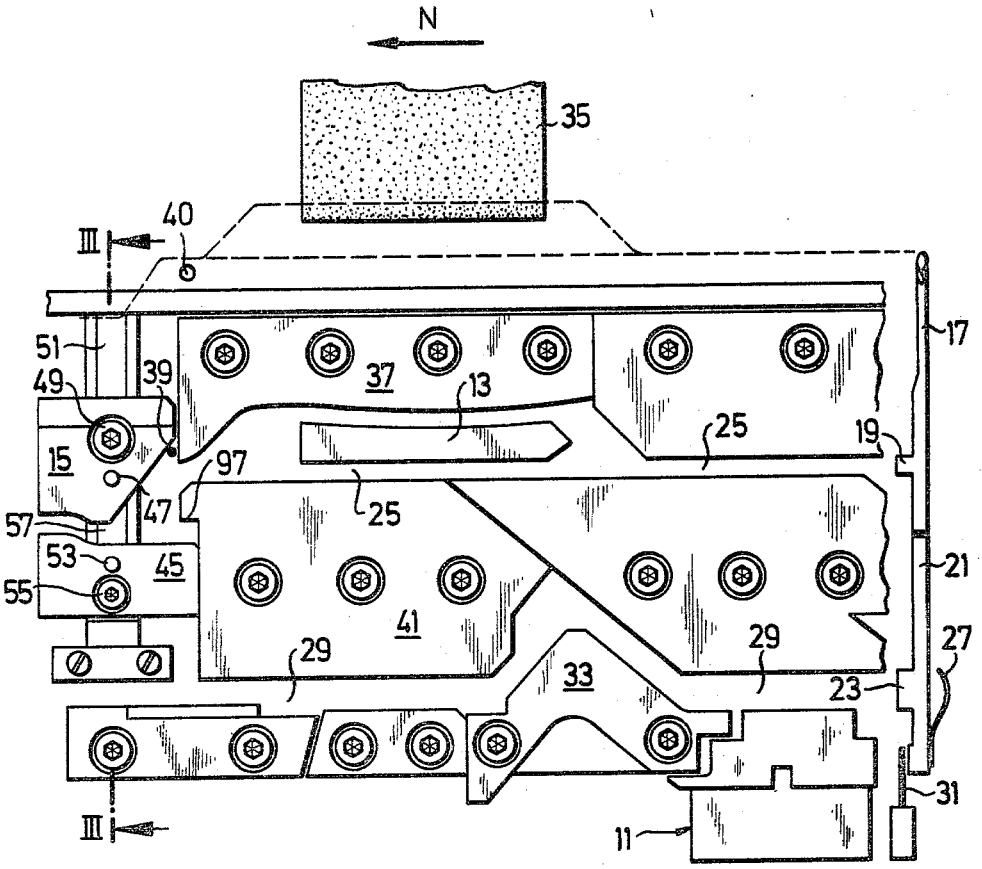
FIG. 1 shows a schematic section of the cam arrangement on a circular knitting machine embodying the invention, for producing fur fabric.

FIG. 1 shows the section of a cam of a circular knitting machine embodying the invention, including a patterning mechanism 11, a feeding point for the sliver, the width and length of which correspond to a section of the feed cam 13, and a knitting cam segment 15, i.e. essentially incorporating a knitting system. About the circumference of a revolving needle cylinder (not illustrated) a total of 12 patterning mechanisms 11 is provided, each with a laying-in cam segment 13 and knitting cam segment 15. In FIG. 1, only those components of a circular knitting machine are illustrated as are necessary for present purposes.

As schematically indicated in the right-hand section of FIG. 1, the circular knitting machine comprises independently selectable knitting needles 17, with butts 19, fitting into the tricks of the needle cylinder. In the same tricks, beneath the knitting needles 17, pivoting jacks 21 with butts 23 are provided. The needle butts 19 are normally arranged in a non-knit track 25 (plush fabric) or tuck track (fur fabric), the jack butts 23, being arranged in a jack track 29, because of the influence of a spring 27 located in the base of the tricks. Every jack is associated with a control spring 31, attached to the needle cylinder, this spring being subject to the influence of the patterning mechanism 11 every time it passes it, such that the jack butt 23 of the relevant jack either remains in the jack track 29 and is then raised by a raising cam 33, or is removed from the jack track 29 by the tilting of the jack, as a result of which it slides behind the raising cam 33.

Such patterning and selection mechanisms are clearly described in U.S. Pat. No. 3,449,928 and in U.S. Pat. No. 3,898,818 to Schmidt, to which reference is made to avoid unnecessary repetition.

The butts 19 of those knitting needles, corresponding to a jack, raised by the raising cam 33, are raised by the jack on to the laying-in cam segment 13. This segment 13 is located at a height such that into the hooks of a knitting needle passing by it, can be fed the fibers from a sliver delivered from a doffer 35 (or the pile thread supplied from a thread feeder). Details of this process are known from the abovementioned specifications and therefore require no repetition at this stage.

The laying-in cam segment 13 adjoins a draw-off cam of a guide cam segment 37, for the purpose of lowering the knitting needles to a height at which they can pick up a ground thread, at a position indicated by the circle 39 the ground thread being fed by a feeder 40. Counter-guiding is effected in this case by a cam segment 41, which also holds the needle butts 19 below the laying-in cam segment 13, in the track 25.

A guide cam segment 45 is provided behind the cam segment 41 and the knitting cam segment 15 is behind the guide cam segment 37, seen in the rotational direction of the needle cylinder (arrow N). The knitting cam segment 15 lowers the needles to the knocking-over position so that from the ground thread laid into their hooks loops are formed into stitches and at the same time, the fibres are incorporated in the stitches of the ground thread. After the stitches have been formed, the knitting needles are raised again to the level of the track 25 by a raising edge on the guide cam segment 45, so that a new selection procedure can take place.

The above-described process of stitch formation is known; the laying-in and incorporating of fiber (or pile threads) can be effected in any appropriate known manner as shown in German DAS 1,585,051 to Nuber published Aug. 21, 1969 or German DAS 1,943,345 to Apprich.

Figure 2:
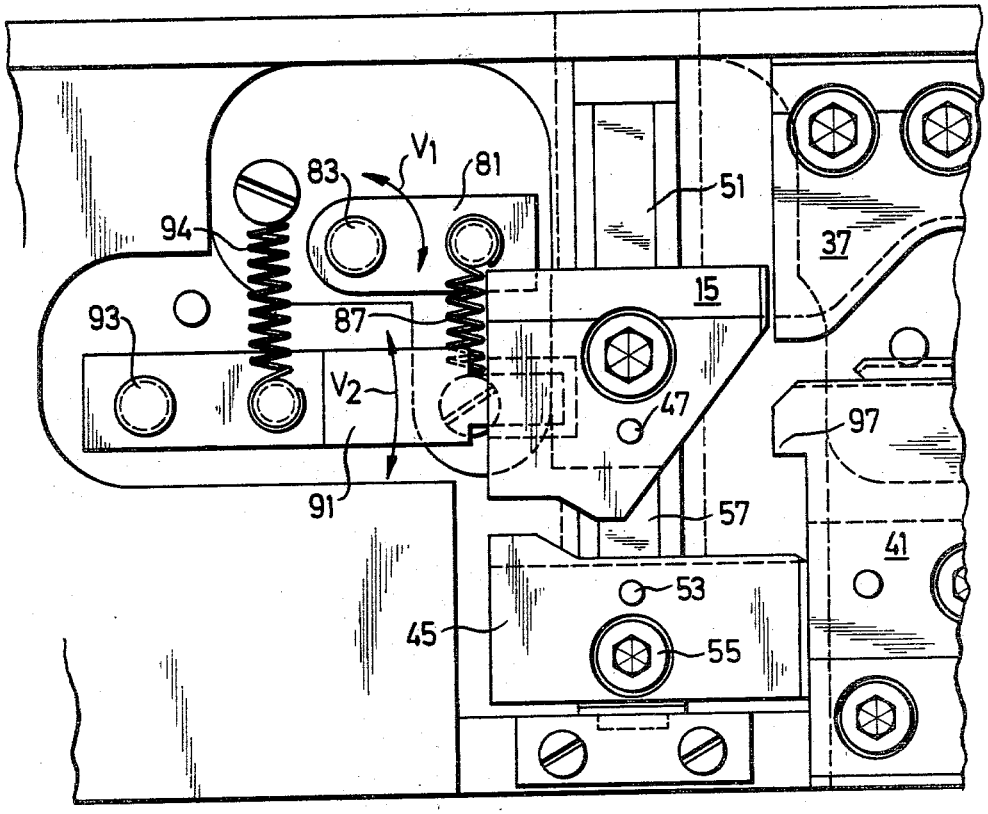
FIG. 2 shows a schematic diagram of the cam arrangement as in FIG. 1 with the omission of certain components.
Figure 3:
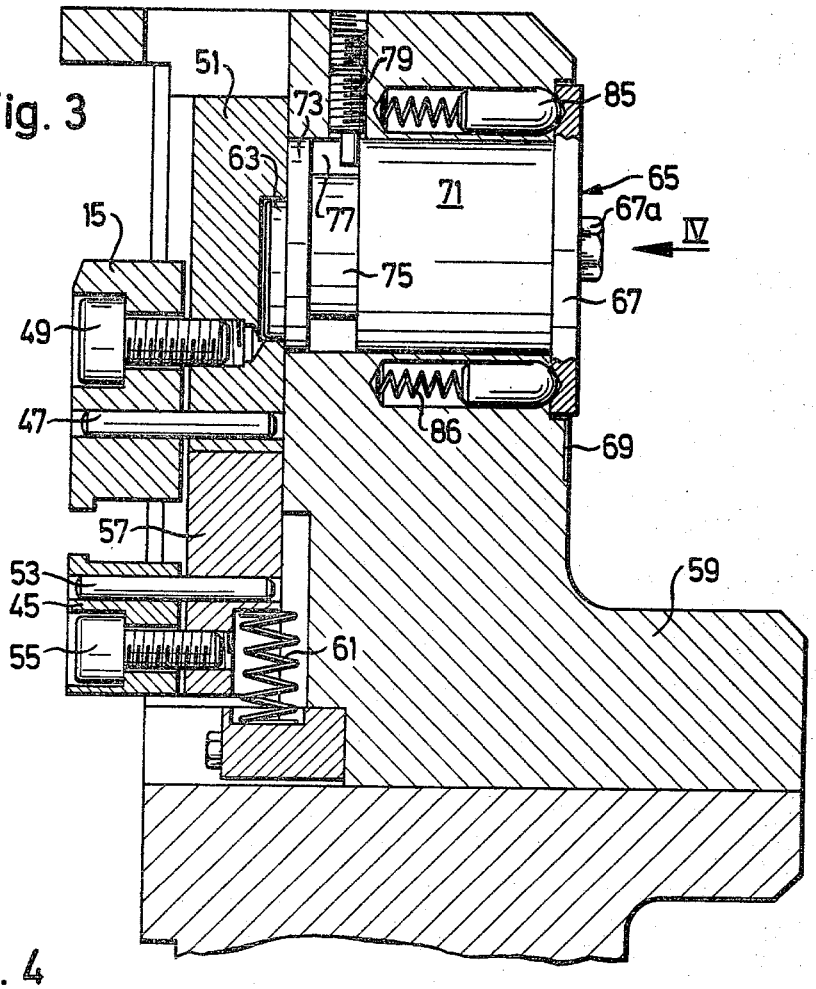
FIG. 3 shows a section along the line III—III of FIG. 1.

The knitting cam segments and the guide cam segments 45, which each, together with a laying-in cam segment 13 and a patterning mechanism 11 constitute a knitting system, are arranged so as to be vertically adjustable. According to FIGS. 2 and 3, the knitting cam segments 15 are attached via a cylinder pin 47 and a securing screw 49 to a slide 51, while the guide cam segments 45 are attached to a slide 57 by means of a cylinder pin 53 and a securing screw 55. The superimposed slides 51, 57 are arranged in vertical guides, suitably designed in the cam box ring 59. The lower slide 57 is influenced by a thrust spring 61, supported on a recess in slide 57 and on a protrusion from the cam box ring 59; this spring may be replaced by a suitable cam, lever, or the like. The upper slide 51 has a recess, into which a cam 63 or a cone, attached to a spindle engages, said cam or cone being attached to a setting means 65 provided in an aperture of the cam box ring 59. The setting means 65 consists of several sections. On its front side, illustrated in FIG. 4, the setting screw 65 has a milled head 67 with a scale, which is adjustable relative to a marking 69 on the cam box ring by means of a screwhead and a key. Adjoining the milled head 67 is a section 71, having a small diameter, corresponding to the aperture in the cam box ring. Between this section 71 and a disc 73, which has the same diameter as the section 71, is a section 75, the diameter of which is much smaller than the diameter of the section 71 and the disc 73, so that a free space 77 is left. Eccentric cam 63 is attached to disc 73. Protruding into this free space are a pin 79, attached to the cam box ring, 59 and a lever 81 (FIG. 2) (not illustrated in FIG. 3), which is secured by means of a journal 83 to a stationary section of the cam box ring, so as to be pivotable in the direction of arrow $V_1$. Between a stationary section of the cam box ring and the reverse side of the milled head 67, two thrust springs 85, 86 are mounted.

To a free arm of the lever 81 is fitted a tension spring 87, the other end being attached to a stationary section of the cam box ring. The lever 81 can be tilted against the pull of the tension spring 87 by means of a hexagonal screw 89 (FIG. 4) provided on the journal 83.

Figure 4:
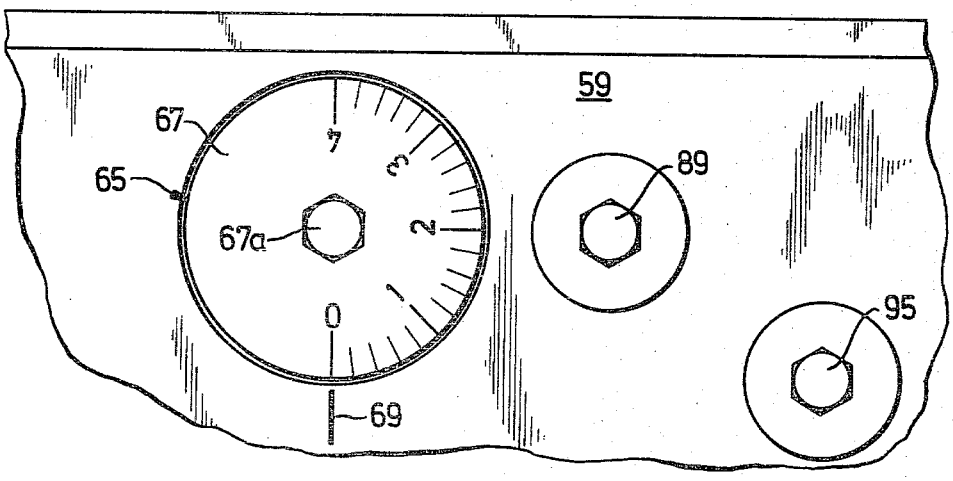
FIG. 4 shows a view in the direction of the arrow IV in FIG. 3.

Into the recess of the slide 51 or of the knitting cam segment 15, there engages the free end of another lever (91) (FIG. 2), which is pivotably mounted via a journal 93 (arrow $V_2$) on the cam box ring and secured to the cam box ring via a tension spring 94. Lever 91 is pivoted by a hexagonal screw 95 provided on the journal 93 (FIG. 4). A stop 97 (FIGS. 1 and 2) is provided on the cam box ring to restrict the vertical movement of the guide cam segment 45.

The mode of operation of the circular knitting machine illustrated is as follows.

During normal knitting, the free end of the lever 81 of each system is under the tension of the spring 87 and is held in the space 77, so that the adjusting means 65 is firmly engaged and the cam 63 is seated in the recess of the slide 51. Lever 91 is in the position shown in FIG. 2, because the slide 51 is held by the cam 63 in the lowest vertical position, as a consequence of which, the slide 57 also assumes its lowest position, counter to the pressure of the thrust spring 61. The two cam segments 15 and 45 assume roughly the position shown in FIG. 1 or 2, this position being variable however by cam 63, (see FIG. 3), according to the desired stitch length, which is predetermined on the scale (FIG. 4). In this position of the two cam segments 15, 45, normal knitting takes place, whereby the ground threads, fed at 39, are formed into stitches while incorporating the fibres, introduced in the region of the laying-in cam segment 13.

If for patterning reasons, several knitting needles pass beneath the laying-in segment 13 at a given system, and do not pick up any fiber, but instead, fiber of the next or next-but-one system are to be incorporated, the knitting cam segment 15 of this system can be brought to the non-knit position, so that all knitting needles in this system pick up no ground thread or in other words, produce no stitches. If required, the relevant thread feeder is also moved to the non-operating position, so that the needles will positively only pick up the ground thread in the next or the next-but-one system in which they are to knit. After passing the knitting cam segment 15, brought into the non-knit position, the knitting needles and/or their jacks pass through the next patterning mechanism 11, and are raised according to pattern, on to the subsequent laying-in cam segment 13. If no stitches are to be formed in this subsequent system either, then the knitting cam segment of this system can also be disengaged. In this manner, the knitting needles are selected on the one hand, in several successive systems and raised to a particular laying-in cam segment 13, in order to pick up fibers of different properties, while on the other hand, they are carried past the knitting cam segments 15, located in the non-knit position, without forming stitches. Only after all the knitting needles have picked up the desired fibers, will they be knocked over by a segment 15 in the knitting position, in order to form stitches with the ground thread and to bind-in the fibers. Despite feeding a plurality of fibers with differing properties, the result is that only a single course is knitted with the ground thread.

To bring a knitting cam segment 15 into the non-knit position, the lever 81 is first raised by using the hexagonal screw 89. In this way, the free end leaves the space 77, so that the setting screw 65 is pressed outwards by the thrust springs 85, 86, until the disc 73 lies against the pin 79. In this position of the setting screw 65, the cam 63 is withdrawn from the recess in the slide 51, so that the two slides 51 and 57 are raised together under the action of the thrust spring 61, while the end of the lever 81 can rest on the disc 73. After the guide cam segment 45 has come into contact with the stop 97, the slide 51 is raised even further by the lever 91, under the influence of the tension spring 94, until the knitting cam segment 15 is no longer under the action of the knitting needles. In this position of the cam segments 15, 45, the needle butts 19 pass by, regardless of the fact whether they have been selected by the patterning mechanism 11 or not, the path followed by the butts 19 being along the track 25, so that no stitch-forming operation can take place. The laid-in pile threads or fibers remain laid-in, unchanged.

If, for the purpose of producing another pattern, selected knitting cam segments are again to be brought into working position, then the slides 51, 57 are pushed to their lowermost position via the lever 91, by actuating the hexagonal screws 95. The setting screw 65 is then pushed into the cam box ring with the result that the cam 63 engages in the recess of the slide 51 while the free end of the lever 81 engages behind the disc 73, thereby stopping the setting screw.

If a holding down sinker 99 (FIG. 5) is associated with every knitting needle, the sinker cam controlling the movement of the holding down sinker is so designed that the holding down sinkers pass through those systems, always in the inactive position, in which the knitting cam segment 15 is in the non-working position. As a result, unnecessary sinker movement is avoided and there is no unfavourable influencing of the already laid-in fibers (or pile threads) by the holding down sinkers.

Figure 5:
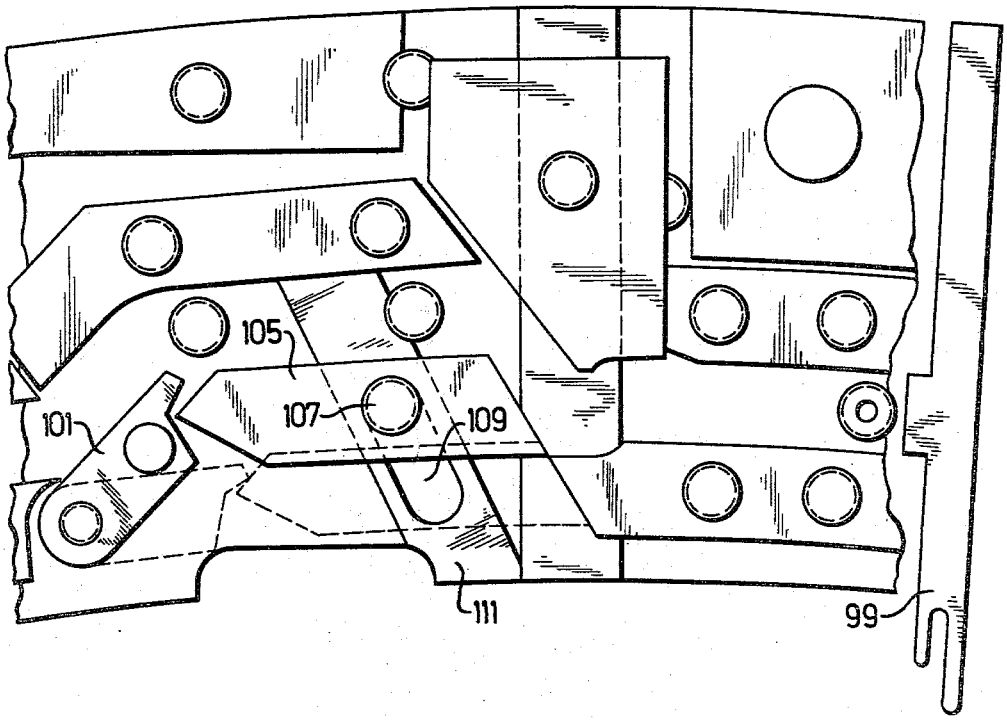
FIG. 5 shows a view from below of the sinker cam.

The raising cams of the holding down sinkers 99 each have a deflector 101, which can be moved into an active position (continuous line) and an inactive position (broken line); they also have a guide cam segment 105, attached in a lateral groove 109 in a cam segment 111, by means of a screw 107. The continuous line position of the guide cam segment 105 corresponds to the active position while the broken line position represents the inactive position (FIG. 5).

The invention is not restricted to the embodiment described. Apart from the fact that the invention is applicable to machines for the production of various types of knitgoods (plush, high pile and, fur fabrics), it is not restricted either to particular methods of stitch formation. For example, it can be used on machines for the production of plush fabrics (terry), or loop-pile fabrics the loops of which are drawn by sinkers while the needles only knit.

Cam segments 15, 45 and 105 and the deflector 101 can be adjusted by devices, which are automatically actuated, such as electromagnets, cylinder/piston arrangements and the like.

Moreover, it is expedient to provide for the feeder means for the fibers (or pile threads) to be engaged or disengaged, so that patterns with 5 color can be knitted, for example, with a total of 12 systems. Those systems not in use are passed by the knitting needles, either in tuck position (fur fabrics) or in miss position (plush or terry fabrics).

Finally, the cam segments 15 and the knitting segments 101, 105, made in one piece, can be designed such that they can be withdrawn from the range of the needle of sinker butts, in a direction vertical to the needles or the holding-down sinkers.

Figure 6:
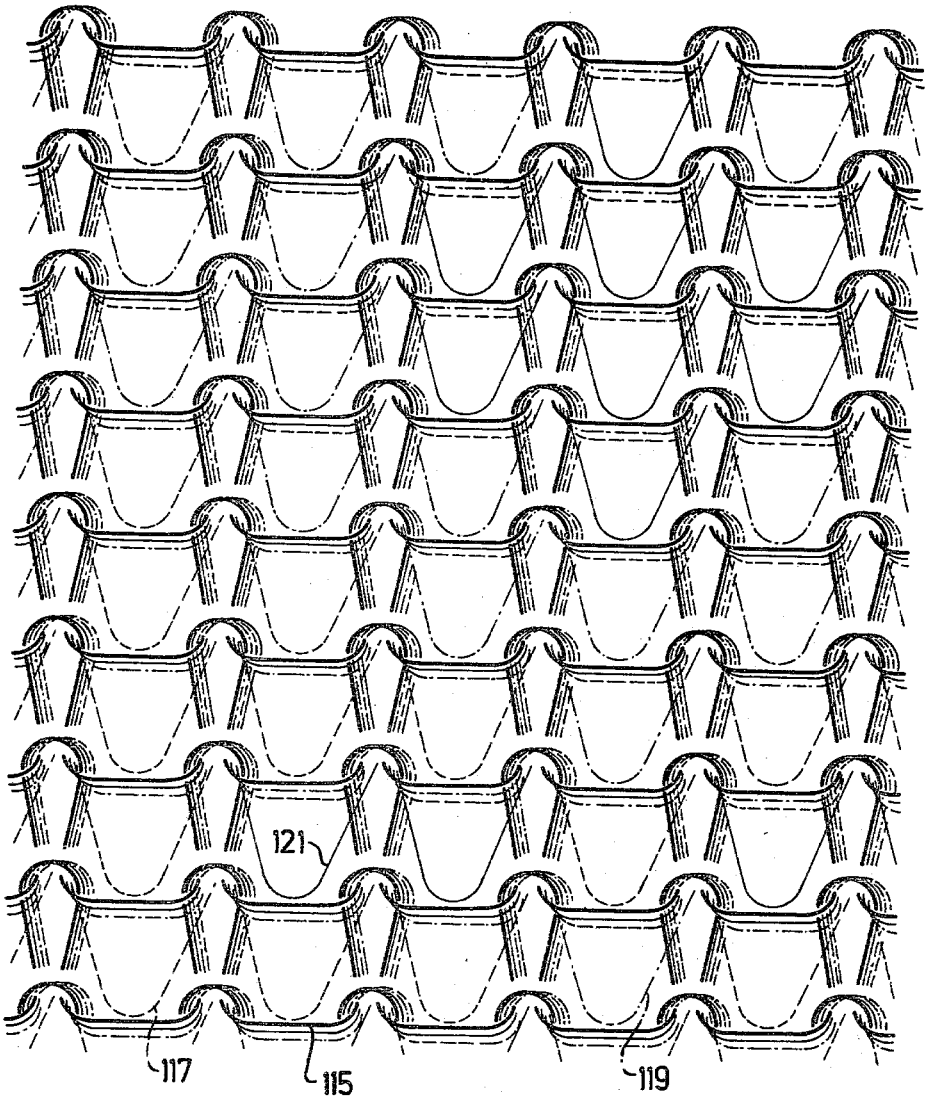
FIGS. 6 and 7 show fabrics produced on a circular knitting machine, as illustrated in FIGS. 1 to 5, FIG. 6 being a plush fabric and FIG. 7 a fur fabric.
Figure 7:
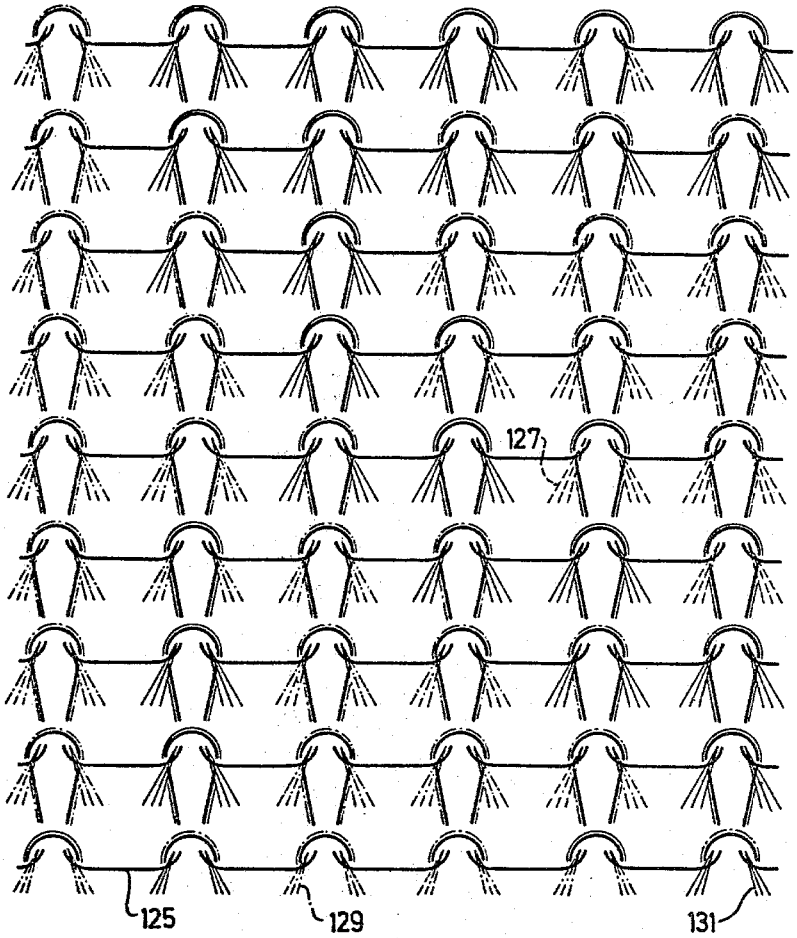

FIGS. 6 and 7 show the fabric which can be produced with the circular knitting machine described. In the plush fabric shown in FIG. 6, a ground thread 115 and three different color pile or plush threads 117, 119, 121 are used; the three color being depicted by different types of line (broken, dot-dash, and continuous). By virtue of the design of the knitting system, according to the invention, it is possible to make the plush loops in any of the three color in every single course.

FIG. 7 shows a fur fabric, in which the ground thread is processed into stitches 125, while one of three different color fibers 127, 129, 131 is combed-in. The color of the fibers, indicated as small fiber tufts, are again illustrated by different line types (broken, dot-dash and continuous). Each of the three fibers can be selected as desired in every single course.

The plush and fur fabrics, illustrated in FIGS. 6 and 7, have a corresponding appearance, if instead of the three colors, only two or more than three colors are envisaged.

What is claimed is:

1. In a machine for producing knitgoods including a ground fabric, knitted from a ground thread, and a pile or plush layer, consisting of pile threads or fibers, the machine having a plurality of individually selectable knitting elements and at least one group of at least two successive knitting systems, each knitting system comprising:

a patterning mechanism for selecting said knitting elements; and only one means for feeding a pile thread or pile fibers to said selected knitting elements, said means for feeding consisting of feeding means for feeding a pile thread or pile fibers of one property to said selected knitting elements;

a feeding means for feeding said ground thread; a knitting cam to produce stitches with said ground thread and said pile thread or fibers by acting on said selected knitting elements; and means for selectively moving said knitting cam to at least a knitting position and to a non knitting position, wherein only the knitting cam of the last knitting system of said group is moved to said knitting position whereas the knitting cams of all preceding systems of said group are moved to said non knitting position, such that the knitting elements selected in a preceding system of said group pass all said preceding systems without producing stitches whereas said knitting cam of said last knitting system acts on the knitting elements selected in any system of said group for producing stitches.

2. In a machine according to claim 1, wherein said moving means includes means for selectively moving said knitting cam to a plurality of said knitting positions, each of said knitting positions corresponding to a different stitch length.

3. In a machine according to claim 1, wherein said moving means includes a first slide to which said knitting cam is attached and means for displacing said first slide at least to said one knitting position and to said non knitting position.

4. In a machine according to claim 3, for producing knitgoods having a desired stitch-length wherein said first slide includes a recess, and comprises a rotatable cam disposed in said recess for altering the stitch length by moving said first slide by said rotatable cam.

5. In a machine according to claim 4, and further comprising a pivotable lever, said first slide being coupled with said pivotable lever, and a spring for resiliently biasing said first slide to move from said knitting position to said non knitting position.

6. In a machine according to claim 3, and further comprising a second slide, a guide cam supported by said second slide and disposed beneath said knitting cam, said second slide being displacable to at least one knitting position and to a non knitting position.

7. In a machine according to claim 6, and further comprising springs for resiliently biasing said first slide and said second slide to move from said knitting position to said non knitting position.

8. In a machine according to claim 6, and further comprising a stop means for limiting the distance the second slide can be moved.

9. In a machine according to claim 1 and further comprising holding-downsinkers and a plurality of clearing cams for controlling said holding-down sinkers, each clearing cam having a deflector and a guide cam segment which are movable into a knitting position and into a non knitting position.

10. In a machine for producing knitgoods including a ground fabric, knitted from a ground thread, and a pile or plush layer, consisting of pile threads or fibers, said machine having a plurality of individually selectable knitting elements and at least one group of at least two successive knitting systems, each knitting system comprising:

a patterning mechanism for selecting said knitting elements; and only one feeding means for feeding a pile thread or pile fibers of one property to said selected knitting elements;

a feeding means for feeding said ground thread;

a knitting cam to produce stitches with said ground thread and said pile thread or fibers by acting on said selected knitting elements; and means for selectively moving said knitting cam to at least a knitting position and to a non knitting position, wherein only the knitting cam of the last knitting system of said group is moved to said knitting position whereas the knitting cams of all preceding systems of said group are moved to said non knitting position, such that the knitting elements selected in a preceding system of said group pass all said preceding systems without producing stitches whereas said knitting cam of said last knitting system acts on the knitting elements selected in any system of said group for producing stitches;

wherein said moving means includes a first slide to which said knitting cam is attached and means for displacing said first slide at least to said one knitting position and to said non knitting position;

wherein said first slide includes a recess, and comprises a rotatable cam disposed in said recess for altering the stitch length by moving said first slide by said rotatable cam; and further comprising a lever biased by a spring for holding said rotatable cam in the recess of said first slide.

11. A method for producing a knitted fabric, including a ground fabric knitted from a ground thread, and a plush or pile layer, consisting of pile threads or fibers having different properties, on a circular knitting machine having knitting needles and a plurality of successive systems, each system having a feeding means for feeding said ground thread, one feeding means for feeding one of said pile threads or fibers of one property, a knitting cam to produce stitches with said ground thread and said one pile thread or fibers, and means for selectively moving said knitting cam to at least a knitting position and to a non knitting position, said method comprising the steps of at first laying only one of said pile threads or fibers with a selected one of a plurality of selectable properties into the hooks of selected ones of said knitting needles at each of so many successive knitting systems as there are selectable properties; laying only in the last of these knitting systems, also the ground thread into the hooks of all selected knitting needles; and forming stitches on all selected knitting needles only in said last knitting system by moving said knitting cams of the other of said successive knitting systems to said non knitting position and leaving only the knitting cam of said last knitting system in said knitting position.

* * * * *